United States Patent [19]

Lesea

[11] Patent Number: 5,021,716

[45] Date of Patent: Jun. 4, 1991

[54] FORWARD INVERTER BALLAST CIRCUIT

[75] Inventor: Ronald A. Lesea, Redwood City, Calif.

[73] Assignee: GTE Products Corporation, Danvers, Mass.

[21] Appl. No.: 525,591

[22] Filed: May 18, 1990

[51] Int. Cl.[5] ..... H05B 41/36

[52] U.S. Cl. ..... 315/219; 315/209 R; 315/DIG. 7

[58] Field of Search ..... 315/219, 209 R, 206, 315/308, 307, DIG. 7, DIG. 5, 247, 287

[56] References Cited

U.S. PATENT DOCUMENTS

| | | | |
|---|---|---|---|
| 3,247,422 | 4/1966 | Schultz | 315/206 |
| 4,251,752 | 2/1981 | Stolz | 315/206 |
| 4,333,139 | 6/1982 | Owen et al. | 315/DIG. 7 X |
| 4,348,615 | 9/1982 | Garrison et al. | 315/219 |
| 4,415,839 | 10/1983 | Lesea | 315/308 |
| 4,613,796 | 9/1986 | Bay | 315/219 |

*Primary Examiner*—Eugene R. LaRoche

*Assistant Examiner*—Ali Neyzari

*Attorney, Agent, or Firm*—Thomas E. Schatzel

[57] ABSTRACT

A forward inverter ballast circuit employs a free-running oscillator (116); a transistor (118); a current-limiting (ballasting) network (120); and two fluorescent lamps (128). The transistor (118) is configured as a switch connected to be responsive to a signal generated (200) by the oscillator (116) and operative to periodically couple a line (234) to a circuit common. The current-limiting network (120) includes a diode (250) and a transformer (240) having a transformer primary winding (244) connected between a DC power-supply potential and the line (234); a first, tightly-coupled, transformer secondary winding (246) connected between the DC power-supply potential and the circuit common; and a second transformer secondary winding (248). In addition, the current-limiting network (120) includes an inductor (252), a capacitor (254), and another capacitor (256), all connected in series across the second transformer secondary winding (248). The lamps (128) are connected across one of the capacitors (256).

7 Claims, 1 Drawing Sheet

Figures 1, 2:
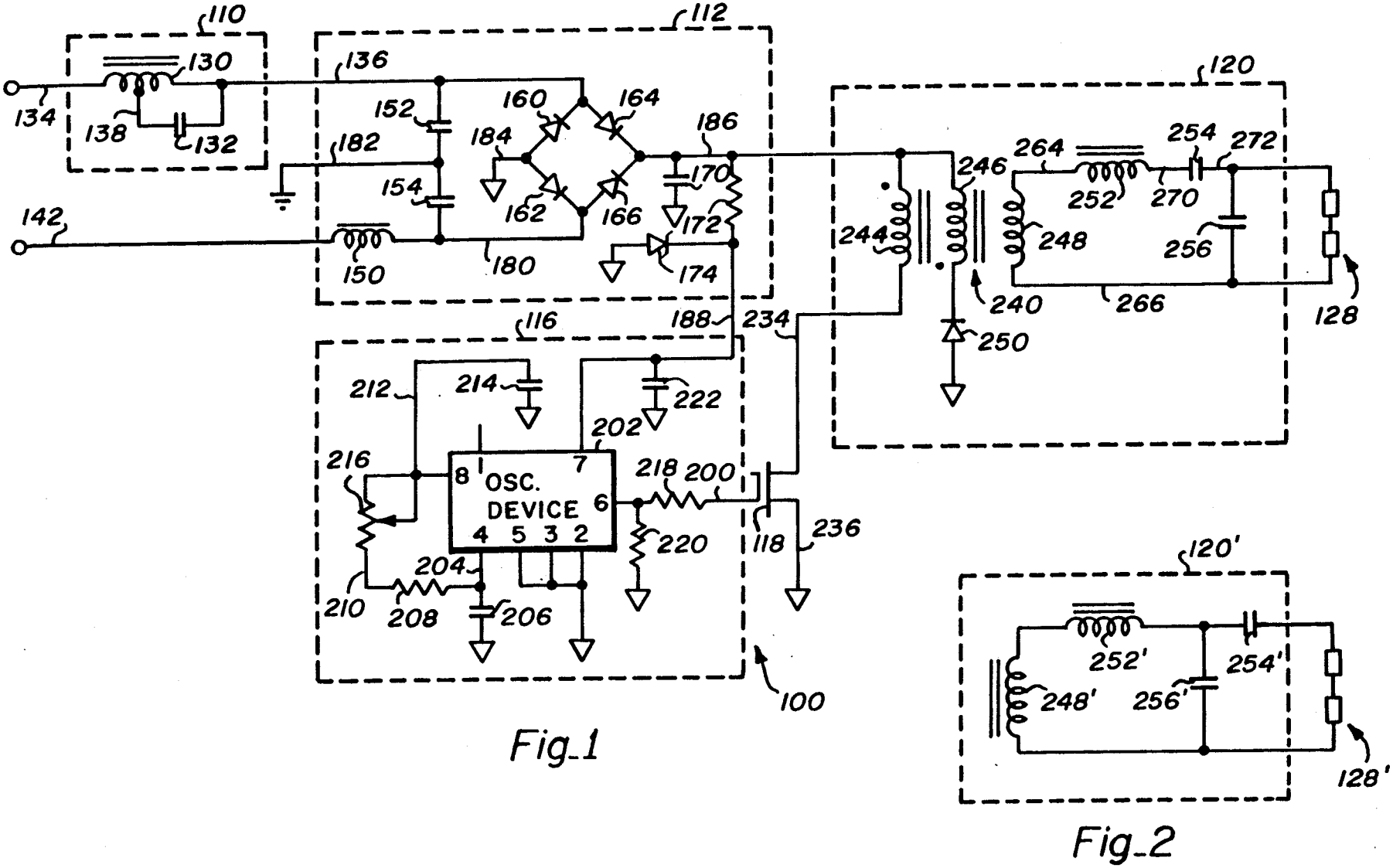

OSC.
DEVICE

FORWARD INVERTER BALLAST CIRCUIT

TECHNICAL FIELD

The present invention relates to the field of energy conversion for lighting generally and more particularly to an electronic ballast suitable for use with gaseous-discharge lamps.

BACKGROUND ART

Gaseous-discharge lamps, lamps in which light is generated when an electric current, or discharge, is passed through a gaseous medium, are not new to the lighting field. Fluorescent-type gaseous-discharge lamps have been employed for years to provide relatively efficient indoor lighting, such as for office buildings.

Unlike incandescent lamps, which are self limiting as a result of their positive-resistance characteristics, gaseous-discharge lamps have a negative-resistance characteristic. For this reason, gaseous-discharge lamps are operated in conjunction with a ballast, which provides the requisite current limiting. Traditionally, ballasts are of core and coil construction. One form is that of a simple choke, which provides an inductive impedance for current limiting. Another form is that of a transformer. The transformer form permits voltage conditioning, such as providing a high break-down potential, which is required for starting instant-start-type fluorescent lamps by ionizing to a plasma the gas therein. For rapid-start-type fluorescent lamps, the transformer includes a pair of windings for energizing the lamp filaments and, separating the pair of filament windings, a high-voltage winding having a high reactance for current limiting. Additionally, a magnetic shunt may be included in the transformer to limit the energy transferred through the magnetic path.

Unfortunately, traditional core-and-coil-type ballasts are relatively inefficient, having substantial heat generating losses that are generally equally divided between copper losses in the coil and core losses in the relatively inexpensive grades of iron employed therein. For example, it is not unusual for a traditional core-and-coil-type ballast employed in a dual 40 watt lamp fixture to dissipate from 15 to 20 watts, causing the ballast to run quite hot. Further, in many applications, such as in office buildings, this ballast-generated heat must be removed by air conditioning equipment, which is itself relatively inefficient. Another problem is that core-and-coil-type ballasts are relatively heavy, requiring that associated fixtures be more substantial than would otherwise be necessary.

The regulation afforded by traditional core-and-coil-type ballasts is, also, relatively poor. Typically, the operating level of fluorescent fixtures employing such ballasts varies as the square of the power-line voltage. Thus, in many applications, excessive lighting, dissipating excessive power, is often employed to insure that minimum lighting levels are achieved.

Among other problems associated with gaseous-discharge lamps is that they are less efficient when operated at the normal 60 Hz line frequency than when they are operated at higher frequencies. Fluorescent lamps are often difficult to start when cold and, as a result, flicker for some time. Fluorescent lamps require core-and-coil-ballast phasing both to reduce stroboscopic effects and to increase the power factor such lamps present to the AC power line via the ballast.

These problems are overcome by my "Electronic Ballast For Gaseous Discharge Lamps," which is disclosed in the U.S. Pat. No. 4,415,839. Briefly, the above mentioned ballast employs a power-factor-correcting network; a DC power supply; a pair of transistors (switches); a pulse generator; and a current-limiting network. To improve the power factor the DC power supply presents to an AC power line (by restricting the amount of power the DC power supply can obtain from the AC power line during peaks of the line cycle), the DC power supply is connected in series with the power-factor-correcting network across a 120 volt, 60 Hz, AC power line. The DC power supply is of a voltage-doubler type which develops on one line a twice-peak-potential level and which develops on another line a potential level one half the twice-peak-potential level, both with respect to a reference-potential level developed on yet another line. The transistors (switches) are connected in a totem-pole configuration in which the channels of the transistors are connected in series between the twice-peak-potential-level line and the reference-potential-level line. The pulse generator is configured to drive the gates of the transistors, in turn, so as to develop at a line at the juncture of the transistors, a source of high-frequency AC power, the waveform of which approximates a square wave. The current-limiting network is configured to couple one, or more, fluorescent lamps between the high-frequency AC power-source line and the return line. In one embodiment, the current-limiting network includes an inductor connected between the high-frequency AC power-source line and a node, a capacitor connected between the node and the return line, and another inductor connected in series with the lamp(s) between the node and the return line.

The above mentioned ballast is disadvantageous in that it provides little isolation from the AC power line. As a consequence, the above mentioned ballast may pose a safety hazard (danger of electrocution) to all who come in contact there with. Further, the above mentioned ballast is relatively complex and expensive.

The U.S. Pat. No. 4,333,139 of D. Owen et al discloses a "Static Inverter" which employs a transistor, a transformer, and a diode, all configured to drive a load. More specifically, the transistor is connected as a switch, with the source of the transistor connected to circuit ground and with the drain of the transistor coupled by a pair of serially connected windings of the transformer to a power supply potential. A pair of serially connected windings of the transformer are connected in series with the diode between the power supply potential and circuit ground. Another winding of the transformer is connected across the load. Although a load is shown in the D. Owen et al patent, it is indicated that the inverter is suitable for use in circuits for starting and re-starting gaseous discharge lamps. The transistor in the D. Owen et al patent is connected in a self-oscillatory configuration, and, thus, does not employ a separate oscillator. In addition, no network is employed in the D. Owen et al patent.

The U.S. Pat. No. 4,348,615 of R. Garrison et al discloses a "Discharge Lamp Operating Circuit" which employs the combination of an oscillator, a transistor, a transformer, and a network, all configured to drive a fluorescent lamp. More specifically, in the R. Garrison et al patent, the transistor is configured with the transistor base connected to the oscillator, with the transistor emitter connected to circuit ground, and with the transistor collector coupled by a transformer winding to a power supply potential. The R. Garrison et al patent discloses, as a "network" the series combination of a wi a capacitor and a lamp.

The reader may find of interest the U.S. Pat. No. 3,247,422 of H. Schultz; the U.S. Pat. No. 4,251,752 of J. Stolz; the U.S. Pat. No. 4,333,139 of D. Owen et al; the U.S. Pat. No. 4,348,615 of R. Garrison et al; the U.S. Pat. No. 4,415,959 of P. Vinciarelli; the U.S. Pat. No. 4,613,796 of D. Bay; and the U.S. Pat. No. 4,802,078 of J. Hill.

DISCLOSURE OF THE INVENTION

It is therefore the primary object of the present invention to provide a ballast circuit which is safe.

Another object of the present invention is to provide a ballast circuit which is relatively simple and inexpensive.

Still another object of the present invention is to provide a ballast circuit which is relatively efficient.

Yet another object of the present invention is to provide a network which presents a relatively high power factor to a transistor switch.

Briefly, the presently preferred embodiment of a forward inverter ballast circuit in accordance with the present invention employs a free-running oscillator (116); a transistor (118); a current-limiting (ballasting) network (120); and two fluorescent lamps (128). The transistor (118) is configured as a switch connected to be responsive to a signal generated (200) by the oscillator (116) and operative to periodically couple a line (234) to a circuit common (potential). The current-limiting network (120) includes a diode (250) and a transformer (240) having a transformer primary winding (244) connected between a DC power-supply potential and the line (234); a first, tightly-coupled, transformer secondary winding (246) connected in series with the diode (250) between the DC power-supply potential and circuit common; and a second transformer secondary winding (248). In addition, the current-limiting network (120) includes an inductor (252), a capacitor (254), and another capacitor (256), all connected in series across the second transformer secondary winding (248). The lamps (128) are connected in series across one of the capacitors (256).

These and other objects of the present invention will no doubt become apparent to those skilled in the art after having read the detailed description of the presently preferred embodiment of the present invention which is illustrated in the figures of the drawing.

BRIEF DESCRIPTION OF THE FIGURES IN THE DRAWING

FIG. 1 is a schematic diagram of the presently embodiment of a forward inverter ballast circuit in accordance with the present invention; and FIG. 2 is a schematic diagram of a portion of another embodiment of the current-limiting network shown in FIG. 1.

BEST MODE FOR CARRYING OUT THE INVENTION

Illustrated in FIG. 1 of the drawing, generally designated by the number 100, is the presently preferred embodiment of a forward inverter ballast circuit in accordance with the present invention. Ballast circuit 100 employs a power-factor-correcting network 110; a DC power supply 112; an oscillator 116; a transistor 118; a current-limiting (ballasting) network 120; and two fluorescent lamps, which are collectively designated 128. Power-factor correcting network 110 includes a tapped inductor 130 and a capacitor 132. Inductor 130 is configured with one (distal) end of the inductor connected to a line 134 and with the other (distal) end of the inductor connected to a line 136. Capacitor 132 is configured with one end of the capacitor coupled by a line 138 to the inductor 130 tap and with the other end of the capacitor connected to line 136. In the presently preferred embodiment, for use with a 120 volt AC power, inductor 130 has 600 turns of number 26 AWG wire wound on a core of the type which is commonly designated EI-21. The winding is tapped 1:9 (60 turns to 540 turns) such that 540 turns are across (in parallel with) capacitor 132. Preferably, capacitor 132 has a capacitance of 3.3 mfd.

DC power supply 112 is configured with the inputs of the power supply connected in series with power-factorcorrecting network 112 across an AC power line to improve the power factor the DC power supply presents to the AC power line (by restricting the amount of power the DC power supply can obtain from the AC power line during peaks of the line cycle). In other words, one input of DC power supply 112 is connected to line 136; line 134 is connected to one side of an AC power line; and, the other input of the DC power supply is coupled by a line 142 to the other side of the AC power line. DC power supply 112 includes an RFI choke 150; a pair of RFI capacitors, respectively designated 152 and 154; four rectifier diodes, respectively designated 160, 162, 164, and 166; a filter capacitor 170; a current limiting resistor 172; and a zener diode 174. The RFI components are configured with choke 150 connected between line 142 and a line 180, with capacitor 152 connected between line 136 and a line 182, and with capacitor 154 connected between lines 182 and 180. Line 182 is connected to earth ground. The rectifier diodes are connected in a bridge configuration with the anode of diode 160 connected to a line 184, with the cathode of diode 160 connected to line 136, with the anode of diode 162 connected to line 184, with the cathode of diode 162 connected to line 180, with the anode of diode 164 connected to line 136, with the cathode of diode 164 connected to a line 186, with the anode of diode 166 connected to line 180, and with the cathode of diode 166 connected to a line 186. Line 184 is connected to a circuit common. Filter capacitor 170 is connected between line 186 and circuit common; and current-limiting resistor 172 is connected between line 186 and a line 188. Finally, zener diode 174 is configured with the diode cathode connected to line 188 and the diode anode connected to circuit common. In the presently preferred embodiment, for operation from a 120 volt AC power line, RFI choke 150 has an inductance of 1.0 mH; RFI capacitors 152 and 154 each have a capacitance of 0.0068 mfd; rectifier diodes 160, 162, 164, and 166 are each of the type which is commonly designated IN4006; filter capacitor 170 has a capacitance of 100 mfd; current limiting resistor 172 has a resistance of 6800 ohms and a size of 5 watts; and, zener diode 174 is of the type which is commonly designated IN5249. As a consequence, DC power-supply 112 develops on line 186 a DC potential of 130 volts and develops on line 188 a DC potential of 20 volts.

Oscillator 116, which is, preferably, of the free-running type, is configured to generate on a line, designated 200, a high-frequency signal, having, preferably, a square-wave shape. In the presently preferred embodiment, oscillator 116 is configured around an integrated-circuit-type device 202, which is of the type that is commonly designated 3844. Specifically, device 202 is configured with the device pins 2, 3, and 5 connected to circuit common and with device pin 4 connected to a line 204, which is both coupled to circuit common by a frequency establishing capacitor 206 and coupled to a line 210 by a frequency establishing resistor 208. Further, device 202 is configured with device pin 8 connected to a line 212, which is both coupled to circuit common by a bypass capacitor 214 and connected to (one end and) the wiper of a potentiometer (variable resistor) 216. The (other) distal end of potentiometer 216 is connected to line 210. Finally, device 202 is configured with device pin 1 unconnected; with device pin 7 connected to line 188; and with device pin 6 both coupled to line 200 by a resistor 218 and coupled to circuit common by another resistor 220. A bypassing capacitor 222 couples line 188 to circuit common. Preferably, capacitor 206 has a capacitance of 0.001 mfd; resistor 208 has a resistance of 11,000 ohms; capacitor 214 has a capacitance of 0.01 mfd; potentiometer 216 has a resistance of 5,000 ohms; resistor 218 has a resistance of 47 ohms; resistor 220 has a resistance of 47,000 ohms; and capacitor 222 has a capacitance of 10 mfd and a voltage rating of 25 volts. With these component values, oscillator 116 generates a high-frequency square-wave signal of 50.0 kHz on line 200.

Transistor 118 is configured as a switch connected to be responsive to the high-frequency signal generated on line 200 by oscillator 116 and operative to periodically couple a line 234 to a line 236, which is connected to circuit common. Although a transistor of the bi-polar type may be employed for this purpose, in the presently preferred embodiment, a transistor of the field effect (FET) type is employed. Specifically, transistor 118 is configured with the transistor gate connected to line 200; with the transistor drain connected to line 234; and with the transistor source coupled by line 236 to circuit common. Preferably, transistor 118 is of the MOS type which is designated IRF730 by International Rectifier, Inc. (An IRF730 transistor has a BVDSS of 400 volts and an RDS(on) of 1.0 ohms.)

Current-limiting (ballasting) network 120 includes a transformer 240, having a transformer primary winding 244, a first transformer secondary winding 246, and a second transformer secondary winding 248; a diode 250; an inductor 252; a capacitor 254; and another capacitor 256. Transformer 240 is of the type which has the transformer primary winding (244) and the first transformer secondary winding (246) tightly coupled. The primary winding (244) of transformer 240 is configured with one end of the winding (244) coupled by line 186 to DC power-supply 112 and with the other (distal) end of the winding (244) connected to the drain of transistor 118 (line 234). The first transformer 240 secondary winding (246) is configured with the winding connected in series with diode 250 between line 186 and circuit common. In other words, either winding 246 is configured with the cathode of the the diode (250) connected to the line (186), with one end of the winding (246) connected to the anode of the diode (250), and with the other (distal) end of the winding (246) connected to circuit common; or, winding 246 is configured with one end of the winding (246) connected to the line (186), with the other (distal) end of the winding (246) connected to the cathode of the diode (250), and with the anode of the diode (250) connected to circuit common. The second transformer 240 secondary winding (248) is configured with one end of the winding (248) connected to a line 264; and with the other (distal) end of winding (248) connected to a line 266. Inductor 252 is connected between line 264 and a line 270. Capacitor 254 is connected between line 270 and a line 272; and, capacitor 256 is connected between lines 272 and 266.

Transformer 240, of current-limiting (ballasting) network 120, among other things, is operative to provide an inductive power-supply feed for transistor 118.

First transformer 240 secondary winding 246 and diode 250, of current-limiting network 120, among other things, are operative to limit the voltage swing developed on line 234, across the channel of transistor 118, to twice the level of the DC power-supply (112) voltage level developed on line 186.

Transformer 240, inductor 252, capacitor 254, and capacitor 256, of current-limiting network 120 are operative to provide an impedance transformation. They, also, provide the desired open circuit output voltage for starting the lamps 128. In addition, they provide the desired source impedance, as seen by the lamps. Also, they establish the operating Q for the desired output waveform. Further, they provide the desired load impedance and phase angle, as seen by transistor 118 for both the operating and open circuit conditions.

Capacitor 254 also prevents a DC current attributable to charge flowing through secondary winding 248, inductor 252, and the fluorescent lamps, from saturating the core(s) of transformer 240 and/or inductor 252. The latter, DC, current would, otherwise, exist were one of the cathodes of one of the lamps to fail so as to cause loss of heating of one end of the lamp so as to cause the lamp to rectify. Unfortunately, the capacitive reactance of capacitor 254 affects the impedance transformation provided by transformer 240, inductor 252, and capacitor 256, of current-limiting network 120. To minimize this affect, preferably, for capacitor 254, a capacitor is employed having a relatively large capacitance and, thus, a relatively small capacitive reactance. To cancel the residual capacitive reactance of capacitor 254 (at least at the fundamental of the oscillator 116 frequency), preferably, the (inductance and, thus, the) inductive reactance of inductor 252 (at that frequency) is increased by the amount of the residual capacitive reactance of the capacitor (at that frequency) over the amount which would be employed for the inductor in the absence of the capacitor.

In another embodiment of the current-limiting network, the configuration of capacitors 254 and 256 (shown in FIG. 1) is changed. This other embodiment of capacitors 254 and 256 is illustrated in FIG. 2 of the drawing. In the drawing similar components are similarly labeled, with the components shown in FIG. 2 being designated with a prime (′). Specifically, in this embodiment, inductor 252′ and capacitor 256′, of current-limiting network 120′, are connected in series across the second transformer secondary winding (246′); and, capacitor 254′, of the current-limiting network, and lamps 128′ are connected in series across capacitor 256′.

The configuration of capacitors 254′ and 256′ (shown in FIG. 2) is advantageous over the configuration of capacitors 254 and 256 (shown in FIG. 1) in that there is less VA stress on capacitor 254' than on capacitor 254 (capacitor 254' conducting the charge attributable to the output current only, as opposed to the charge attributable to the output plus shunt currents conducted by capacitor 254).

In the presently preferred embodiment, transformer 240 (shown in FIG. 1) has a core of the type which is designated PQ and of the material which is designated H7C1 by TDK, Inc. The transformer 240 primary winding (244) and first transformer secondary winding (246) are, preferably, wound together as 128 turns of number 28 bifilar wire. Also, preferably, the second transformer 240 secondary winding (248) is wound as 110 turns of number 28 AWG wire. Preferably, inductor 252 has an inductance of 0.941 mH; capacitor 254 has a capacitance of 0.068 mfd; and capacitor 256 has a capacitance of 0.01 mfd.

Lamps 128, which are, preferably, of the type that is designated F40T12, are connected in series between lines 272 and 266. Lamp cathode heating is provided by three one-turn windings on transformer 240 (not shown).

In the presently preferred embodiment, the values of the components of current-limiting (ballasting) network 120 are calculated in accordance with one of the following two sets of formulas:

| | |
|---|---|
| As a first approximation: | |
| Xc(256) = | $-Rl(128)/Q$; |
| Rsec(248) = | $N(240)^2 * Rin$; |
| Esec(248) = | $N(240) * Ein$; |
| Xl(252) = | $Q * Rsec(248)$; |
| Q = | $((Rl(128)/Rsec(248)) - 1)^{\frac{1}{2}}$; |
| Eout = | $Esec * Xc/(Xc(256) + Xl(252))$; |
| L(252) = | $3.1831\ e^{-6} * Xl(252)$; |
| C(256) = | $-3.1831\ e^{-6}/Xc(256)$; |
| f = | $1/(2 * Pi * 3.1831\ e^{-6})$; |
| More precisely: | |
| Xc(256) = | $-Rl(128)/Q$; |
| Xlsec(248) = | $Rsec(248)/((Rsec(248) * (Q^2 + 1)/Rl(128)) - 1)^{\frac{1}{2}}$; |
| Xl(252) = | $Rl(128) * Q/(Q^2 + 1)) * (1 - (Rsec(248)/(Q * Xlsec(248))))$; |
| Xin = | $(Xl(252) + Xc(256)) * Xlsec(248)/(N(240)^2 * (Xlsec(248) + Xl(252) + Xc(256)))$; |
| Rin = | $Rsec(248)/N(240)^2$; |
| Esec(248) = | $Ein * N(240)$; |
| Eout = | $Esec * Xc(256)/(Xl(252) + Xc(256))$; |
| L(252) = | $3.1831\ e^{-6} * Xl(252)$; |
| Lsec(248) = | $3.1831\ e^{-6} * Xlsec(248)$; |
| C(256) = | $3.1831\ e^{-6}/Xc(256)$; |
| Lpri(244) = | $Lsec(248)/N(240)^2$; |
| f = | $1/(2 * Pi * 3.1831\ e^{-6})$; |

Where:

Ein is the RMS (equivalent fundamental sine wave) voltage level which is developed by transistor 118 (between lines 186 and 234).

Eout is the desired RMS open-circuit output voltage level which is to be developed across lamps 128 (between lines 277 and 266) before the lamps ignite.

Esec is the secondary 248 voltage.

N(240) is the turns ratio (secondary-to-primary) of transformer 240.

Q is the resultant loaded input Q presented by current-limiting network 120 to transistor 118 (between lines 186 and 234).

Rin is the input impedance which is to be presented by current-limiting network 120 to transistor 118 (between lines 186 and 234) to yield the desired lamp power level.

R1(128) is the loaded lamp impedance of lamps 128.

Rsec(248) is impedance at the transformer (240) secondary winding 248.

Xc(256) is the resultant capacitive reactance of capacitor 256.

Xin is the resultant open circuit (no load) reactance looking into current-limiting network 120 (before lamps 128). It is important to note that this is nonzero. In other words, a resonant condition does not exist. Of course, were a resonant condition to exist, an infinite current would result, the core of transformer 240 would saturate and damage to the components would result.

X1(252) is the resultant inductive reactance of inductor 252.

Xlsec(248) is the required inductive reactance for transformer 240 secondary 248, neglecting the primary.

| | |
|---|---|
| For: | |
| Rin = | 170 ohms; |
| Ein = | 114 volts; |
| Rl(128) = | 650 ohms; |
| Eout = | 450 volts; and |
| C(256) = | 0.01 mfd. |
| f = | 49,999.98 Hz; |
| Then: | |
| C(256) = | 0.01 mfd; |
| Ein = | 114.0000 volts; |
| Eout = | 450.0000 volts; |
| Esec(248) = | 98.23240 volts; |
| f = | 49999.98 Hz; |
| L(252) = | 0.0007920341 henrys; |
| Lpri(244) = | 0.008595181 henrys; |
| Lsec(248) = | 0.006381972 henrys; |
| N(240) = | 0.8616878; |
| Q = | 2.042034; |
| Rin = | 170.0000 ohms; |
| Rl(128) = | 650.0000 ohms; |
| Rsec(248) = | 126.2260 ohms; |
| Xc(256) = | −318.3100 ohms; |
| Xin = | −96.94177 ohms; |
| Xl(252) = | 248.8248 ohms; and |
| Xlsec(248) = | 2004.955 ohms |

It is contemplated that after having read the preceding disclosure, certain alterations and modifications of the present invention will no doubt become apparent to those skilled in the art. It is therefor intended that the following claims be interpreted to cover all such alterations and modifications as fall within the true spirit and scope of the invention.

What is claimed is:

1. A ballast circuit for driving at least one gaseous discharge lamp (128), the ballast circuit comprising in combination:

means (112) for developing a DC power-supply potential (186) with respect to a circuit common (236);

an oscillator (116) for generating a high-frequency oscillator signal (200);

a line (234);

a transistor (118) connected to said oscillator (116), to said line (234), and to said circuit common (236), said transistor being configured as a switch responsive to said oscillator generated signal (200) and operative to periodically couple said line (234) to said circuit common (236); and a current-limiting network (120) including, a diode (250), a transformer (240) including a transformer primary winding (244) connected between said DC power-supply potential (160) and said line (234), a first, tightly-coupled, transformer secondary winding (246) connected in series with said diode (250) between said DC power-supply potential (186) and said circuit common (236), and a second transformer secondary winding (248), means having inductive reactance at said high frequency (252), and capacitor means (256) connected in series with said inductive reactance means (252) across said second transformer secondary winding (248) and for connection across said lamp (128).

2. A ballast circuit for driving at least one gaseous discharge lamp (128), the ballast circuit comprising in combination:

means (112) for developing a DC power-supply potential (186) with respect to a circuit common (236);

an oscillator (116) for generating a high-frequency oscillator signal (200);

a line (234);

a transistor (118) connected to said oscillator (116), to said line (234), and to said circuit common (236), said transistor being configured as a switch responsive to said oscillator generated signal (200) and operative to periodically couple said line (234) to said circuit common (236); and a current-limiting network (120) including, a diode (250), a transformer (240) including a transformer primary winding (244) connected between said DC power-supply potential (160) and said line (234), a first, tightly-coupled, transformer secondary winding (246) connected in series with said diode (250) between said DC power-supply potential (186) and said circuit common (236), and a second transformer secondary winding (248), inductor means (252'), first capacitor means (256') connected in series with said inductor means (252') across said second transformer secondary winding (248'), and second capacitor means (254') for connection in series with said lamp (128') across said first capacitor means (256').

3. A ballast circuit for driving at least one gaseous discharge lamp (128), the ballast circuit comprising in combination:

means (112) for developing a DC power-supply potential (186) with respect to a circuit common (236);

an oscillator (116) for generating a high-frequency oscillator signal (200);

a line (234);

a transistor (118) connected to said oscillator (116), to said line (234), and to said circuit common (236), said transistor being configured as a switch responsive to said oscillator generated signal (200) and operative to periodically couple said line (234) to said circuit common (236); and a current-limiting network (120) including, a diode (250), a transformer (240) including a transformer primary winding (244) connected between said DC power-supply potential (160) and said line (234), a first, tightly-coupled, transformer secondary winding (246) connected in series with said diode (250) between said DC power-supply potential (186) and said circuit common (236), and a second transformer secondary winding (248), inductor means (252), first capacitor means (254), and second capacitor means (256) connected in series with said first capacitor means (254) and said inductor means (252) across said second transformer secondary winding (248) and for connection across said lamp (128).

4. A ballast circuit as recited in claim 3 wherein two or more gaseous discharge lamps (128) are connected in series across said second capacitor means (256).

5. A ballast circuit as recited in claim 3 wherein said transistor includes a gate connected to said oscillator (116) and a channel having a first end connected to said line (234) and a second end connected to said circuit common (236).

6. A ballast circuit as recited in claim 5 wherein said transistor is of the type which is commonly designated IRF730.

7. A ballast circuit as recited in claim 3 wherein said oscillator is of the free-running type.

* * * * *